US005480371A

United States Patent [19]

Morita et al.

[11] Patent Number: 5,480,371

[45] Date of Patent: Jan. 2, 1996

[54] BOX FORMING EQUIPMENT

[75] Inventors: Shigeru Morita, Iruma; Hiroshi Ishida, Tsurugaoka; Isao Hirano, Saitamaa, all of Japan

[73] Assignee: Nippon Flute Company, Ltd., Japan

[21] Appl. No.: 156,820

[22] Filed: Nov. 24, 1993

[30] Foreign Application Priority Data

Dec. 1, 1992 [JP] Japan ..... 4-322047

[51] Int. Cl.[6] ..... B31B 1/60

[52] U.S. Cl. ..... 493/117; 53/136.4; 493/183; 493/382

[58] Field of Search ..... 493/114, 115, 493/116, 117, 147, 156, 157, 183, 162, 127, 383, 382; 53/136.4, 376.4, 377.2, 378.3, 387.2; 156/468, 355, 443

[56] References Cited

U.S. PATENT DOCUMENTS

| | | | |
|---|---|---|---|
| 2,891,367 | 6/1950 | Shenigo | 53/377.2 |
| 3,775,937 | 12/1973 | Devan et al. | 53/75 |
| 3,981,123 | 9/1976 | Flanagan | 53/377.2 |
| 4,004,401 | 1/1977 | Loveland | 53/376.4 |
| 4,498,893 | 2/1985 | Odom | 493/12 |
| 4,515,581 | 4/1985 | Molitor et al. | 53/377.2 |
| 4,598,526 | 7/1986 | Milligan et al. | 53/251 |
| 4,632,666 | 12/1986 | Ulrich et al. | 493/23 |
| 4,813,206 | 3/1989 | DiRusso, Jr. et al. | 53/136.4 |
| 4,915,678 | 4/1990 | Morita | 493/183 |
| 5,323,586 | 6/1994 | Lissoni et al. | 53/136.4 |

FOREIGN PATENT DOCUMENTS

| | | | |
|---|---|---|---|
| 0182204 | 7/1989 | Japan | 493/162 |
| 0182443 | 7/1990 | Japan | 493/183 |
| 0000622 | 1/1991 | Japan | 53/376.4 |

*Primary Examiner*—Bruce M. Kisliuk
*Assistant Examiner*—Christopher W. Day
*Attorney, Agent, or Firm*—Bradford E. Kile; Ruffin B. Cordell; Michael J. McKeon

[57] ABSTRACT

A box forming apparatus for folding and securing the bottom flaps of a box including a bottom flap folding mechanism and top pressing mechanism located above the bottom flap folding mechanism for controlling box lifting during a box folding operation. The novel features of the claimed invention allow for controlled guiding of a box frame throughout a folding and sealing operation.

9 Claims, 6 Drawing Sheets

BOX FORMING EQUIPMENT

BACKGROUND OF THE INVENTION

This invention relates to box forming equipment. More specifically, this invention relates to box forming equipment which automatically folds bottom box flaps and seals the flaps with tape to produce a closed end box. This application is related to the subject matter of prior U.S. Pat. No. 4,915,678 of common assignment with the subject application.

In the past boxes have been made by removing a folded box blank from stock material stored at a box material supply station and raising and spreading the box material into a box frame. The box forming equipment folds the front and back inner flaps of the raised box material into a bottom opening plane of the box frame and then folds left and right outer flaps onto the bottom opening plane of the box frame to form a bottom plate. The box material is then fed out onto an upward-facing tape head which seals the facing edges of the left and right outer flaps with a single-sided adhesive tape while the box is being transported by a pair of side belts. Satisfactory tape sealing, however, cannot be performed if the box material lifts after being fed out to the tape head. Therefore, a top pressing mechanism controls such lifting over the area from the bottom flap folding mechanism to the tape head. Previously known top pressing equipment contains a vertically moveable piece of flat board whose size can accommodate box material of various sizes.

Although prior box forming equipment has been utilized with some success, previously known top pressing units have been located above the box material, covering the entire surface folded by the bottom flap folding mechanism. Therefore, it is not possible to observe whether or not a normal folding process is performed beneath the flat board. Accordingly, improperly folded bottom flaps may be sealed in an improper form with tape and rendered unusable.

The difficulties suggested in the preceding are not intended to be exhaustive, but rather are among many which may tend to reduce the effectiveness and satisfaction with prior box forming machines. Other noteworthy problems may also exist; however, those presented above should be sufficient to demonstrate that box forming equipment appearing in the past will admit to worthwhile improvement.

OBJECTS AND BRIEF SUMMARY OF THE INVENTION

Objects

It is therefore a general object of the invention to provide a novel box forming apparatus which will obviate or minimize difficulties of the type previously described.

It is a specific object of the invention to provide box forming equipment which allows an operator to observe an area under a top pressing mechanism so that improperly folded flaps may be seen as they occur and avoided.

It is another object of this invention to provide a top pressing mechanism which decreases the potential for box flaps to be bent upon pressing.

It is a further object of this invention to provide a top pressing mechanism which requires no adjustment to correspond to changes in outer box flap size.

It is still a further object of his invention to provide box forming equipment which is operable to form a box with a closed bottom in a condition for subsequent use.

BRIEF SUMMARY OF A PREFERRED EMBODIMENT

A preferred embodiment of the invention which is intended to accomplish at least some of the foregoing objects comprises a bottom flap folding mechanism which folds the front and back inner flaps and then the left and right outer flaps into a bottom opening plane of the box frame. The bottom flap folding mechanism includes a back inner flap folding body which folds the back inner flap into the bottom opening plane of the box frame and rotates upward and downward to feed box material out onto the tape head. A top pressing mechanism, located above the bottom flap folding mechanism, controls lifting of the box material. The top pressing mechanism includes a vertically movable body, projected from the back side of the box material to the upper center area of the box material, which can ascend and descend freely above the bottom flap folding mechanism. The top pressing mechanism also includes shaft supported rollers located at both the left and right sides of the vertically movable body extending transversely in long, multiple lines. Finally, a pair of downwardly inclined side belts catch and transport the box material while the bottom part of the box material is pressed against an upward facing tape head, which seals the left and right outer flaps with tape.

THE DRAWINGS

Other objects and advantages of the present invention will become apparent from the following detailed description of a preferred embodiment thereof taken in conjunction with the accompanying drawings, wherein:

FIG. 1 an axonometric view of a box body which has been expanded into a solid rectangular configuration before being formed by the subject box forming equipment;

DETAILED DESCRIPTION

Context of the Invention

Prior to providing a detailed description of the subject invention, reference to the context of the invention may be worthwhile. In this connection, FIG. 1 discloses box material consisting of conventional corrugated box board. The box material 1 has a box frame composed of a front end panel 2*a*, a back end panel 2*b*, and left and right side panels 2*c* and 2*d*. The lower flaps of this box frame consist of a front inner flap 3*a*, a back inner flap 3*b*, and left and right outer flaps 3*c*, and 3*d* which will form the bottom plate of a completed box. These flaps are folded into the bottom opening plane of the box frame along folding lines 4*a*, 4*b*, and 4*c*, respectively. Front and back inner flaps 5*a*, 5*b*, and left and right outer flaps 5*c* and 5*d* compose the upper flaps of the box frame.

Figure 2:
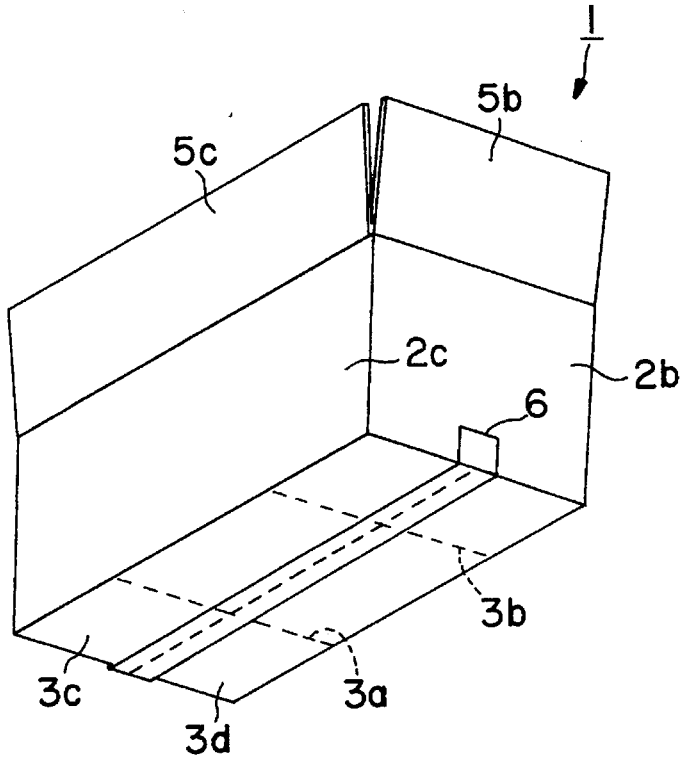
FIG. 2 is an axonometric view of the box body with a closed bottom portion that is formed by the subject box forming equipment.

The subject box forming equipment operably folds the front and back inner flaps 3*a*, 3*b* on the bottom part of the box material 1 into the bottom opening plane of the box frame. The box forming equipment then folds left and right outer flaps 3*c* and 3*d* into the bottom opening plane of the box frame and feeds the box material out onto an upward facing tape head. The tape head seals the facing edges of the left and right outer flaps 3*c* and 3*d*, note FIG. 2, with a strip of single-sided adhesive tape 6 while the box material is caught and transported by a pair of downwardly-inclined side belts.

Box Forming Equipment

Figure 1:
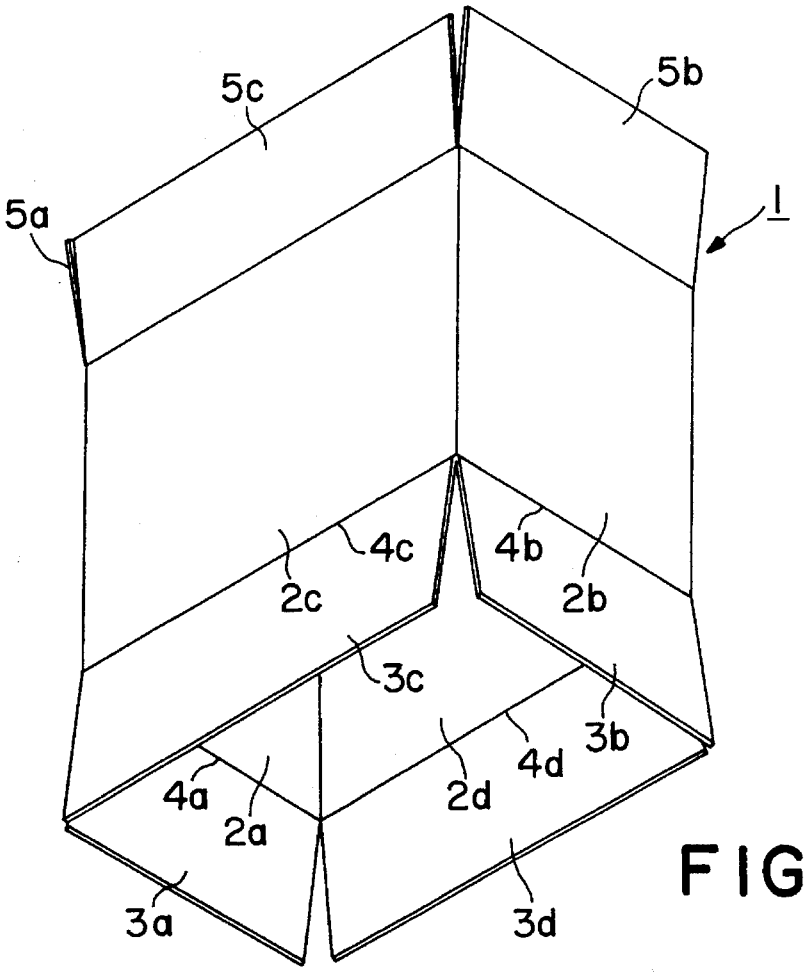
Figure 3:
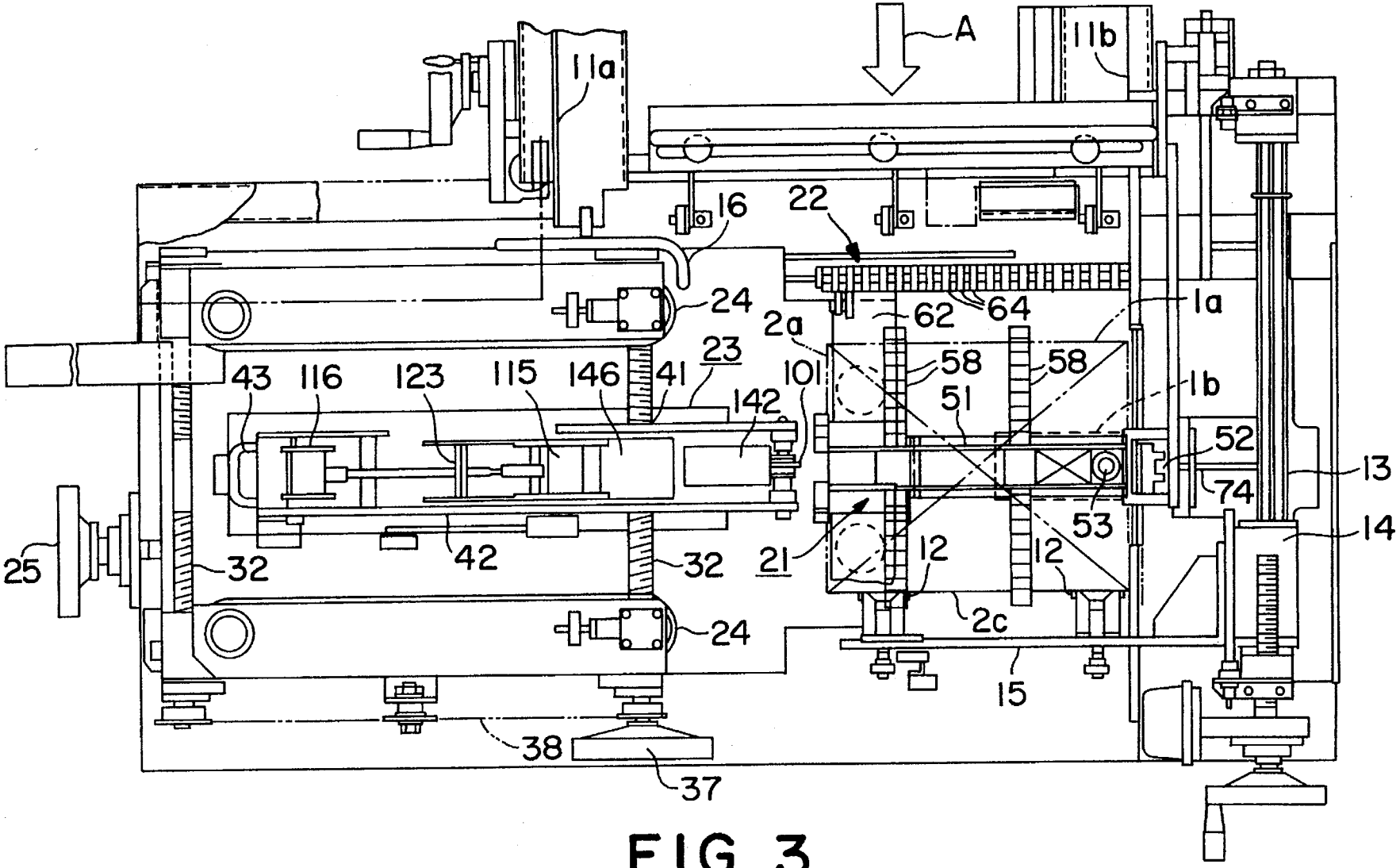
FIG. 3 is a top view of the box forming equipment.

Turning to FIGS. 3 through 8, wherein like reference numerals indicate like parts, FIG. 3 discloses a top view of the box forming equipment, which includes a box erecting frame, according to the subject invention. A pair of box material entrance guides 11*a*, 11*b* are positioned on a left side of the box forming machine. Between these guides 11*a*, 11*b* a number of box stock material, its position which will be opened as shown in FIG 1. The box stock is stored vertically in a flatly folded state, so that the front end panel 2*a* is closely contacted with the right side panel 2*c*, and the back end panel 2*b* is closely contacted with the left side panel Four top and bottom, left and right vacuum suction pads 12 face in the direction opposite from which the box materials enter, as indicated by directional arrow "A". These vacuum suction pads 12 are attached to a movable body 14 by means of a mounting plate 15. The movable body 14 moves along a suction pad moving guide 13, situated at the right side of the equipment, by means of an air cylinder (not shown in drawing) attached under the moving guide 13.

The vacuum suction pads 12 move forward to the left side panel 2*c* of one of the box materials, which is folded between the box material entrance guides 11*a*, 11*b*, engage the left side panel 2*c* with a vacuum, and retreat to the position shown in FIG. 3. Accordingly, the function of the suction pads 12 is to draw a piece of box material to be formed into a box into the apparatus.

In an inner area of one end of the box material entrance guide 11*a*, a J-shaped box frame opening guide 16 is located at a fixed position to make contact with the front end panel 2*a* of the box frame so as to make the box frame open to the state shown in FIG. 1. The opening guide 16, however, will not completely open the box material. Rather, the means to keep the front end panel 2*a* exactly at a 90 degree angle to the left side panel 2*c*, which is held securely by the vacuum suction pads 12, note FIG. 1, is provided at the tape head and will be described in detail later.

Installed on the center line of the equipment, note FIG. 3, is a top pressing mechanism 21, a bottom flap folding mechanism 22, a tape head 23, and a pair of side belts 24. The top pressing mechanism 21 is positioned over the box materials 1*a* or 1*b* box material feeding body/support frame 74 and controls lifting of the box material. The bottom flap folding mechanism 22 folds the front and back inner flaps 3*a* and 3*b*, which are attached to the bottom of the box material 1*a* or 1*b*, into the bottom opening plane of the box frame.

A tape head 23 faces up at a feed-out side (left side) of a bottom flap folding mechanism 22 and seals the facing edges of the left and right outer flaps 3*c* and 3*d* with tape 6. The pair of side belts 24 attached at both sides of the tape head catch and transport the box materials 1*a* or 1*b*.

The pair of side belts 24 incline slightly downward to the tape head in the direction (left) of box material advancement.

The box frame opening guide 16, the tape head 23, and the pair of side belts 24 are attached at an upper plane of a moving, adjusting table 2*e*. The adjusting table 28 is attached to a screw rod 26 which is rotated by a handle 25. The table 28 can be moved and adjusted according to the size of the box material 1*a* (large box) or 1*b* (small box) along the direction of a guide 27.

Figure 4:
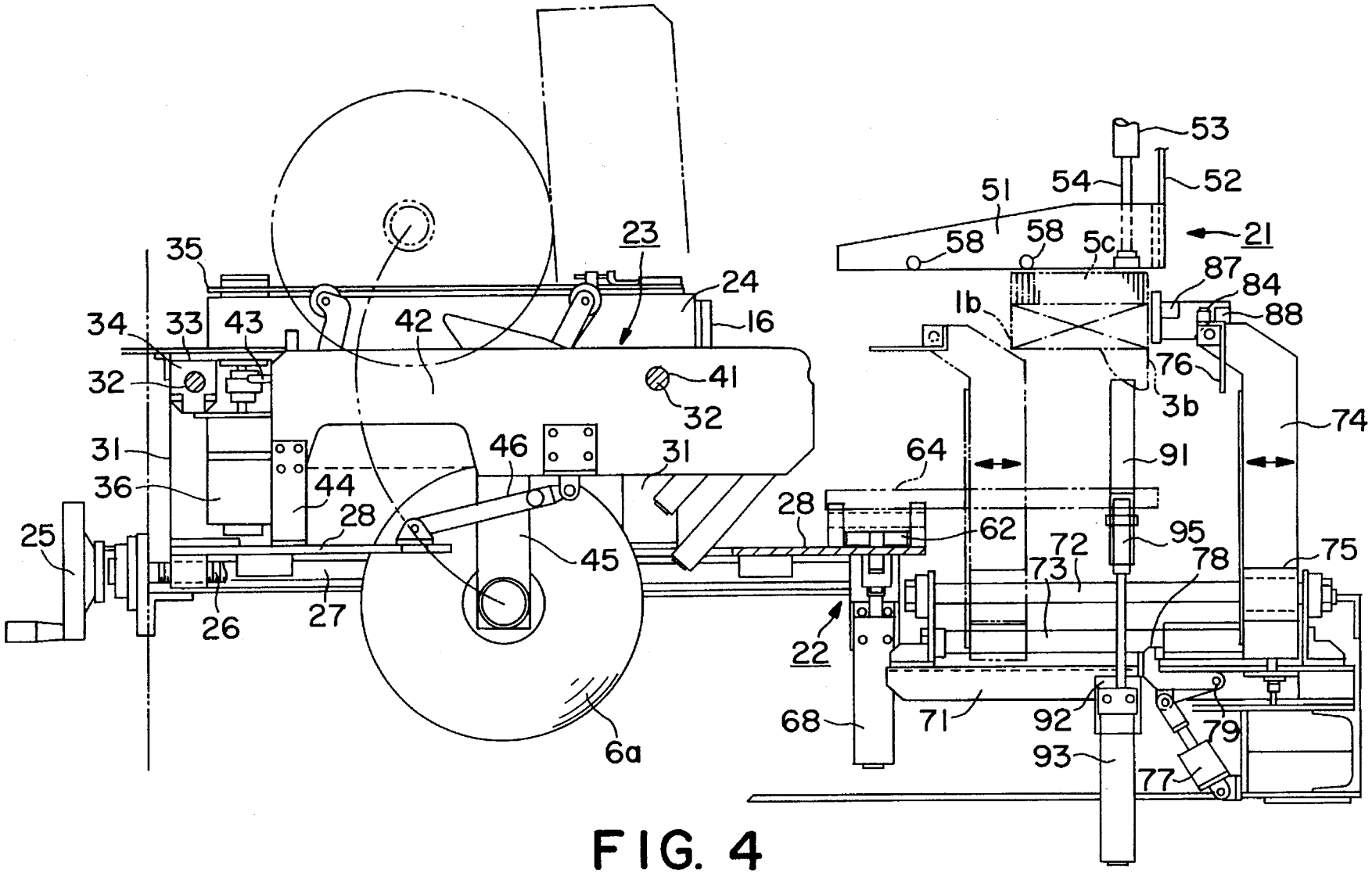
FIG. 4 is a right, cross-sectional view of the box forming equipment depicted in FIG. 3.

The box frame opening guide 16, the tape head 23 and the pair of side belts 24, note FIGS. 3 and 4, are positioned to correspond to a maximum size box material 1*a;* however, when smaller size box material 1*b* is used, the moving adjusting table 28 is operable to be moved toward the box material 1*b*, and the tape head 23 and other parts are positioned closer to the box material.

The pair of side belts 24 include two screw rods 32 which are supported on the moving adjusting table 28 by two sets of rod support plates 31 so as to enable the rods to rotate freely. A pair of belt width adjusting frames 33, with threaded holes 34, are attached at the lower parts of both frame ends. Each of the screw rods 32 screw into the threaded holes 34 in both ends of each frame 33. Shaft-supported pulleys 35 are located at both ends of each frame 33. The side belts 24 wrap around the pulleys 35. The driving system of the side belts 24 include: pulley shafts at each end which are driven by geared motors 36 with a speed control function. A geared motor is installed under one end of each belt width adjusting frame 33. The facing side planes of the pair of side belts 24 are driven in the box material feeding direction at equal speeds. The right and left ends of the two screw rods 32 are threaded in opposite directions and interlock with a belt width adjusting handle 37 and chain transmission mechanism 38.

When the two screw rods 32 are rotated by the belt width adjusting handle 37, the distance between the pair of side belts 24 is made wider or narrower so that the pair of side belts 24, along with the pair of belt width adjusting frames 33, can always be positioned at equal distance from a center line of the machine. Accordingly, the operating width of the side belts can be adjusted according to the size of the box material.

The tape head 23 is operably connected to a central portion of one of the screw rods 32 which is made non-threaded to function as a tape head rotating shaft 41. As shown in FIG. 4, by making the tape head rotating shaft 41 an axis, the main head unit 42 can be lifted and rotated up (the direction which the leg 44 at one end of the tape head detaches from the moving/adjusting table 28) by holding a grip 43 on the end of the tape head. Therefore, a roll of bottom flap sealing tape 6*a*, which is installed under the main head unit 42 by means of a tape installing plate 45, can be rotated up, as depicted in phantom lines in FIG. 4, along with the main head unit 42, enabling easier removal and replacement of the tape.

The top pressing mechanism, note FIGS. 3 and 4 includes a vertically movable body 51, which is projected from the back side of the box material 1*a* or 1*b* to the upper center area of the box material. The top pressing mechanism is installed so as to ascend and descend freely along a vertical guide member 52 at a rear part of the body by means of an air cylinder 53. A piston rod 54 of the air cylinder 53 is connected to a bottom plate of the vertically movable body 51. Holders 55 are fixed at two locations on the vertically movable body 51, note FIG. 6. Roller shafts 56 fit into a plurality of bearing rollers 58 which are inserted into the holders 55. A center portion of the grouped rollers are secured within the holders 55 by set screws 57, and both sides of the rollers transversely project from the vertically movable body 51. Accordingly, a long two-line roller-type, top pressing unit is constructed which extends from both sides of the vertically movable body 51. Stoppers 60 are fixed on the ends of the roller shafts 56 with bolts 59 so as to prevent the bearing rollers 58 from slipping off the roller shafts 56, note FIG. 5.

Figure 5:
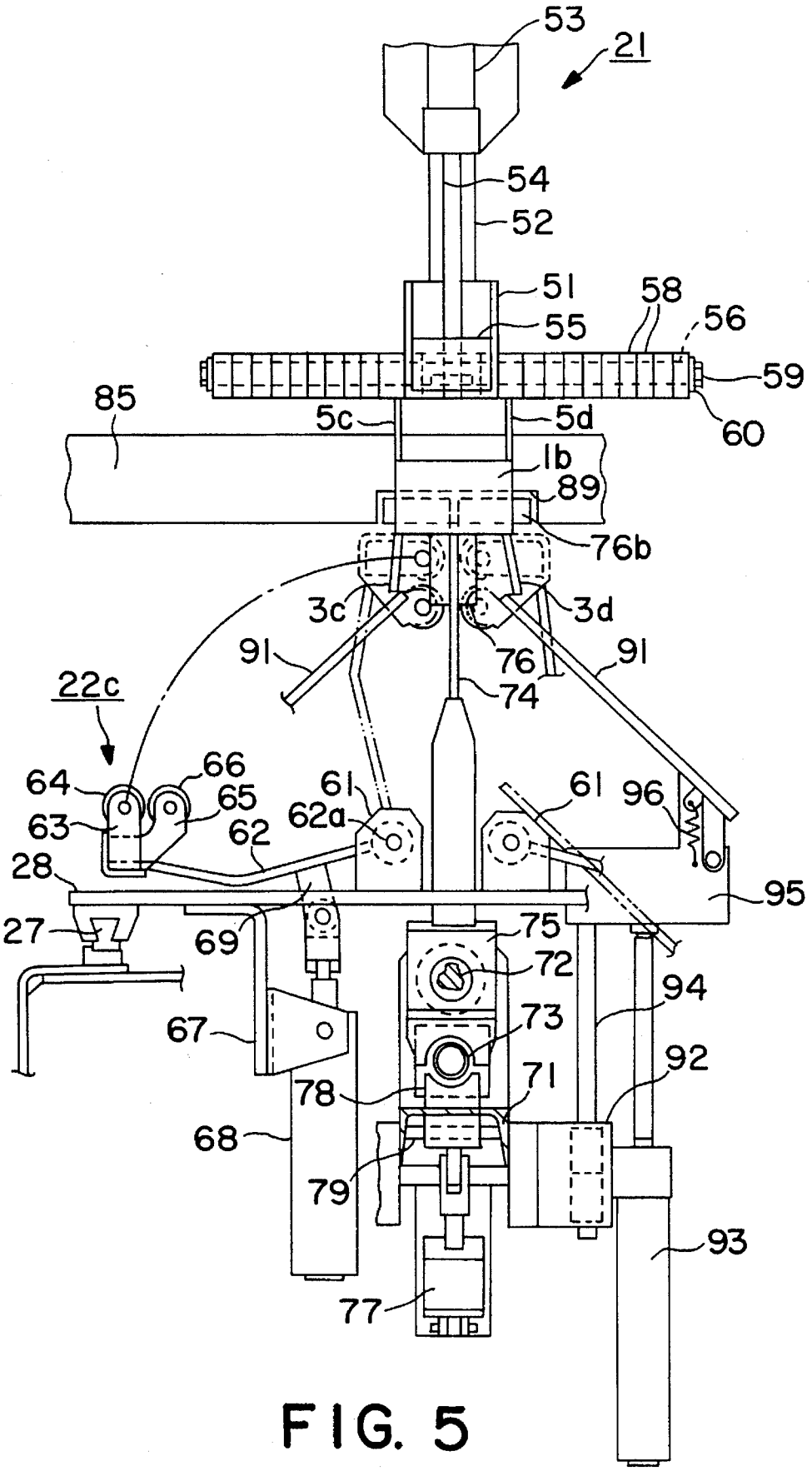
FIG. 5 is a front view of the box forming equipment depicted in FIG. 3 without a tape head.
Figure 6:
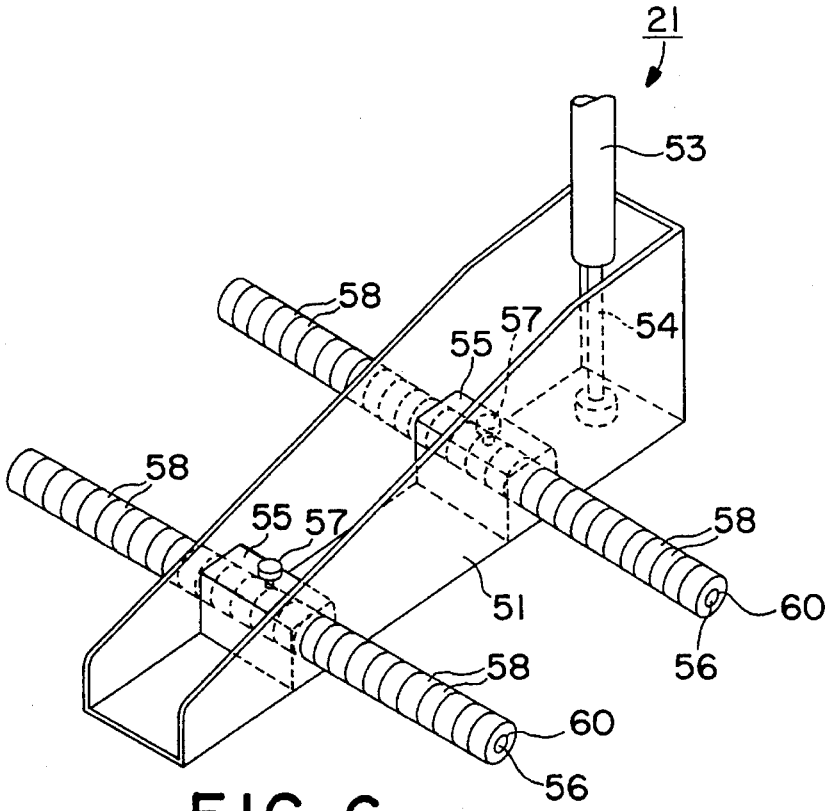
FIG. 6 is an axonometric view of a top pressing mechanism of the box forming equipment depicted in FIG. 3.

As shown in FIGS. 5 and 6, when box material 1*a* or 1*b* is carried in, the vertically movable body 51 is lowered by the air cylinder 53 for the set stroke portion in accordance with the box material size. The bearing rollers 58, which are installed at the left and right sides of the vertically movable body 51, are brought down to the top edges of the left and right outer flaps 5*c* and 54, respectively, on the upper part of the box frame. Accordingly, lifting of the box material at the time of bottom flap folding or at the time of box material feeding onto the tape head 23 is prevented while, at the same time, the box material is fed out smoothly onto the tape head 23 by action of the freely rotating bearing rollers 58. If the box frame size becomes so small that the rollers 58 may possibly interfere with the vacuum suction pads 12, the operator can loosen the set screw 57 and move the rollers to the opposite side.

Figure 7:
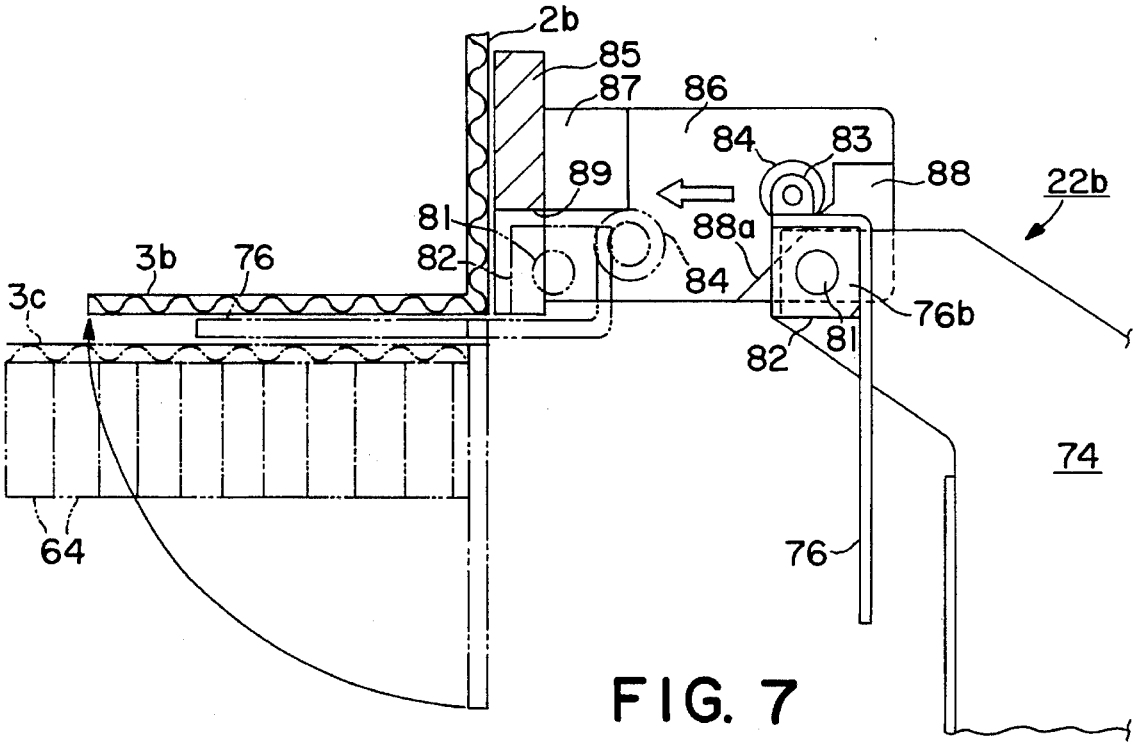
FIG. 7 is a sectional view of the back inner flap folding mechanism of the box forming equipment depicted in FIG. 3.
Figure 8:
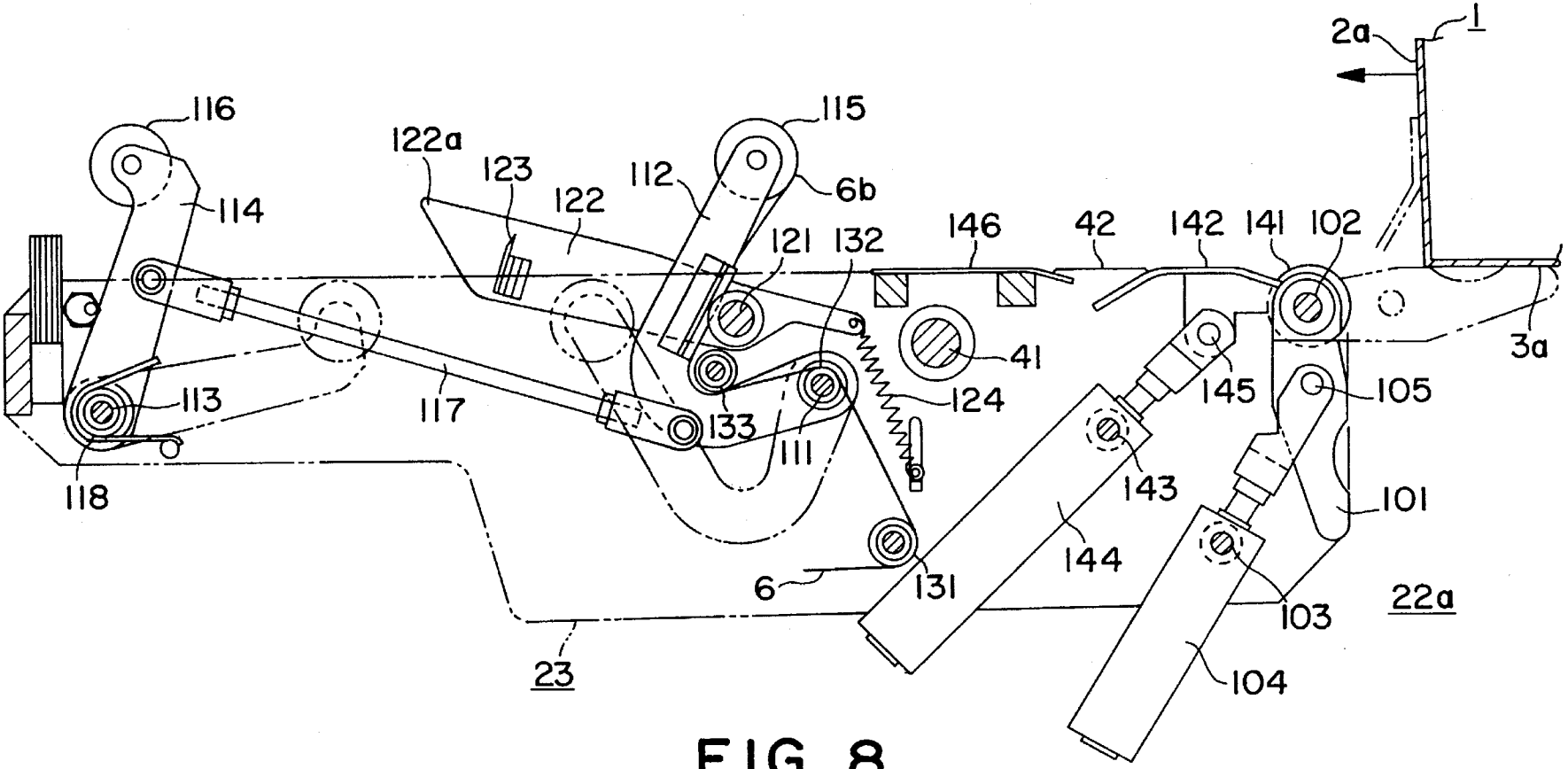
FIG. 8 is a sectional detail view of a front inner flap folding mechanism of the box forming equipment.

The bottom flap folding mechanism 22, which folds the bottom flaps of the box frame (the front inner flap 3*a*, the back inner flap 3*b* and the left and right outer flaps 3*c* and 3*d*) into the bottom opening plane, consists of a front inner flap folding mechanism 22*a*, attached at the opposite end of the tape head 23, note FIG. 8, a back inner flap folding mechanism 22*b*, note FIG. 7, and left and right outer flap folding mechanism 22*c*, note FIG. 5.

The left and right outer flap folding mechanism 22*c*, as shown in FIG. 5 includes base ends of arms 62 which are rotatably supported by shaft receiving plates 61 at the left and right sides of the moving and adjusting table 2*e*. A plurality of bearing rollers 64 are rotatably supported at the tips of the left and right arms 62 by means of support plates 63 for folding the left and right outer flaps. Subrollers 66 are supported inside the bearing rollers 64 by means of support plates 65. Air cylinders 68 are rotatably supported under both the left and right parts of the moving and adjusting table 28, and the solid projected pieces 69 coming out from the arms 62 are connected to the top ends of the piston rods in each air cylinder 68 by shafts (not shown in drawing). FIG. 5 displays the mechanism of the air cylinders 68 and other members only at the left side; however, the mechanism is symmetrically constructed at both sides.

The left and right outer flap folding mechanism 22*c* operates with the arms 62 initially in an open, waiting state under the left and right sides of the box material 2*a* or 2*b*, which is in rectangular formed by a method to be described later. When the arms 62 are driven to pivot up on the base and axis 62*a* by the air cylinders 68, the sub rollers 66 begin to fold the left and right outer flaps 3*c* and 3*d* and the bearing rollers 64 continue to fold the left and right outer flaps, into the bottom opening plane of the box frame, causing the flaps 3*c* and 3*d* to become horizontal.

The back inner flap folding mechanism 22*b* is shown in FIGS. 4 and 5. A guide lock 72 is installed on a base mount 72 and is slide fitted into a lower slide part 75 of a box material feeding body/support frame 74. The feeding body 74 is moved toward the tape head 23 by an air cylinder 73. A back inner flap folding body 76 is supported at the top part of the box material feeding body 74 so as to pivot up and down. Further, a back inner flap folding completion stopper 78 is supported at the base mount 72 by means of a shaft 79 and pivots by means of an air cylinder 77.

In the back inner flap folding body 76, note FIG. 7, a square shaped member 76*b* is located at the upper part of a reverse L-shaped plate member 75*a*. The square-shaped member 76*b* is installed at the top part of the box material feeding body 74 so as to pivot freely on an axis 82. The bottom surface of the square-shaped member 76*b* becomes the box material pressure surface 82. A shaft-supported cam follower roller 84 is located on the edge of the square-shaped member 76*b* so as to pivot freely on an axis support 83. To work with this cam follower roller 84, a cam mounting plate 86 is attached at the back side of the box material entrance guide bar 85. A folding body operating cam 87 and a return cam 88 are attached to the cam mounting plate 86. The return cam 88 is attached to an inclined plane 88a so as to rotate the cam follower roller 84 counterclockwise from the perspective of the axis 82 when the box material feeding body Withdraws. A folding body passing groove 89 is attached under the box material entrance guide bar 85.

The back inner flap folding mechanism 22*b* when the box material feeding body 74 is moved forward by the air cylinder 73 (to the left from the state shown in FIG. 7). The cam follower roller 84 makes contact with the facing surface of the folding body operating cam 87 and moves in under it while rotating clockwise from the perspective of the axis 82 and keeps rotating until the back flap inner folding body 76, which was facing down, becomes horizontal. The back inner flap folding body 76 folds the back inner flap 3*b* into the bottom opening plane of the box frame, and the back inner flap folding completion stopper 78 stops movement of the box material feeding body 74 temporarily.

Outer flap push up bodies 91 open the left and right outer flaps 3*c* and 3*d* slightly outward at the time of folding of the front and back inner flaps 3*a* and 3*b*, and are shown on the left and right sides in FIGS. 4 and 5. These left and right outer flap push up bodies 91 move up or down by means of air cylinders 93 installed at the base mount 71 along guides 92. The top ends of the piston rods of the air cylinders 93 are connected to up and down members 95 with rods 94 slide fitted into guides 92. The base ends of the outer flap push up bodies 91 are shaft supported at the up and down members 95 and are maintained at the angle indicated in FIG. 5 by tension springs 96. FIG. 5 displays the mechanism of the air cylinders 93 and other members only at the right side; however, the mechanism is symmetrically constructed at both sides.

The left and right outer flap push up bodies 91 are raised by the air cylinders 93 from the positions indicated by two dotted phantom lines, note FIG. 5, when the front and back inner flaps 3*a* and 3*d* are folded and open the bottom edges of the left and right outer flaps 3*c* slightly outward, so that the folding of the front and back inner flaps 3*a* and 3*b* can be performed smoothly.

The front inner flap folding mechanism 22*a* is shown in FIG. 8. The tape head 23 is positioned near the front end 2*a* of the box material 1 by means of the moving and adjusting table 28. At the edge, where the box material's end faces opposite the main head unit 42 of the tape head 23, a front inner flap folding body 101 is installed for folding the front inner flap 3*a* on the bottom of the box frame into the bottom opening plane so as to pivot on a shaft 102. The top end of the piston rod of the air cylinder 104, which is rotatably, shaft supported at the main head unit 42 by a shaft 103, is connected to the front inner flap folding body 101 by a shaft The front inner flap folding mechanism 22*a* functions with the piston rod of the air cylinder 104 being pushed, the front inner flap folding body 101 rotates around the shaft 102 from the position indicated by continuous lines to the position indicated by two dotted chain lines, note FIG. 8, in order to fold the front inner flap 3*a* on the bottom of the box frame and into the bottom opening plane.

The structure of the tape head is shown in FIG. 8. One head arm 42, which is bent in a semi-V shape, is installed at the main head unit 42 by a shaft 111 so as to rotate freely. The other head arm 114 is also rotatably installed by a shaft 113. Sealing rollers 115 and 116 are rotatably supported on the head arms 112 and 114. The bent part of the head arm 112 is connected to the middle of the other head arm 114 by a connection link 117 so that linked head arms 112, 114 rotate back and forth in opposition. A coil spring 118 is attached to the base of the other head arm 114. The coil spring 118 and the connection link 117 force both head arms 112 and 114 to project upward.

A cutter arm 122 is attached to the main head unit 42 so as to pivot on a shaft 121. A tape cutting blade 123 is installed at an inner side of the tip 122*a* of the cutter arm 122. An adjustable tension coil spring 124 provides a force to the cutter arm 122 to enable the arm tip to project upward.

A beginning portion 6*b* of the tape 6, which is pulled out from a roll tape 6*a*, note FIG. 4, is pulled up to the box material by a sealing roller 115, note FIG. 8, and is threaded over multiple guide rollers 131, 132, and 133 which are rotatably supported at the main head unit 42. The adhesive side of the tape faces the box material side. Further the operation of the tape head 23 is described below.

As shown in FIG. 8, the main head unit 42 of the tape head 23 is attached to the shaft 102 at the side facing the box material 1. A pair of rollers 141 are rotatably installed at the shaft 102 along with the rotating front inner flap, folding body 101. A box frame folding body 142 is rotatably installed between the pair of rollers. The box frame forming body 142 is connected by a shaft 145 to the top end of the piston rod of the air cylinder, which is rotatably supported at the main head unit 42 by a shaft 143. A bottom flap guide plate 146 is fixed between the box frame forming body 142 and the head arm The box frame forming body 142 pivots by means of the air cylinder 144 as indicated in FIG. 8 by dot and dash lines. In connection with box withdrawal by the vacuum suction pads 12, note FIG. 3, the front end 2*a* adjacent to the vacuumed side 2*c* of the box frame is partially bent by the box frame opening guide 16. The box frame forming body 142 presses the center of the front end 2*a* to enable it to form a right angle with the vacuumed side 2*c* so that the box frame looks truly rectangular, from a plan perspective.

Box Forming Process

A stack of collapsed box materials, note again FIG. 1, is stored in a near vertical, flat, folded state between the box material entrance guides 11*a* and 11*b*. A box to be formed is held by the vacuum suction pads 112 and is carried to the position indicated in FIG. 3. While the box frame is being carried in, the front end 2*a* of the box material makes contact with the box frame opening guide 16, to form an imperfectly opened box frame (meaning that the front end 2*a* is not established at a perfect right angle to the left side 2*c* secured by the vacuum suction pads 12).

By raising the box frame forming body 142, note FIG. 3, in a vertical position, the center of the front end which is adjacent to the left side 2*c*, is pressed so that the front end 2*a* is formed at a right angle to the vacuumed side 2*c*. This makes the box frame look rectangular from a plan view perspective.

The vertically movable body 51, note FIG. 4, of the top pressing mechanism 21 is lowered to the top edges of the box material 1*a* or 1*b*. While the top flap edges are held by the multiply lined bearing rollers 58, the left and right outer flap push up bodies 91 are raised from the position indicated by dot and dash lines, note FIG. 5, to the position indicated by continuous lines so as to open the left and right outer flaps 3*c* on the bottom of the box frame slightly outward. This action prevents the left and right outer flaps 3*c* from interfering with folding of the front inner flap 3*a* and the back inner flap 3*b* in the next sequence.

When the box material feeding body 74 of the back inner flap folding mechanism 22*b*, note FIG. 7, is moved forward, causing the back inner flap folding body 76 to rotate to a horizontal position by action of the folding body operating cam 87 and the cam follower roller 84, so as to fold the back inner flap 3*b* into the bottom opening plane of the box frame. The air cylinder 104 of the front inner flap folding mechanism 22*a*, note FIG. 8, causes the front inner flap folding body 101 to rotate to a horizontal state so that the center of the front inner flap 3*a* is pushed up by the front inner flap folding body 101. The front inner flap 3*a* is folded into the bottom opening plane of the box frame. The left and right outer flap push up bodies 92 are brought down by the cylinder 93 to cancel the operation.

The left and right arms 62 of the left and right outer flap folding mechanism 22*c*, note FIG. 5, are rotated up by the air cylinders 68, and the left and right outer flaps 3*c* and 3*d* are folded into the bottom opening plane of the box frame by the bearing rollers 64 and the sub-rollers 68. At this moment, the back inner flap folding body 76, which is already rotated up as shown in FIG. 7, is placed between the back inner flap 3*b* and the left and right outer flaps 3*c* and 3*d*.

Securing of the box material by the vacuum suction pads 12 is canceled, and the box frame forming body 142 located at the position indicated by the dot and dash lines, note FIG. 8, is returned to the position indicated by a continuous line. After the back inner flap folding completion stopper 78, note FIG. 4, is released by the cylinder 77, the box material feeding body 74 is moved toward the tape head 23 by the air cylinder 73 and the square-shaped member 76*b* of the back inner flap folding body 76 presses the back end 2*b* of the box material with the pressure surface 82 to feed the box material out toward the tape head 23.

Lifting of the box material 1*a* or 1*b* fed from the bottom flap folding mechanism 22 onto the tape head 23 is controlled by the top pressing mechanism 21. The top pressing mechanism 21 lowers the vertically movable body to a fixed level and presses down the top edges of the left and right outer flaps 5*c* on the top of the box frame with multiple lines of bearing rollers 58, which are shaft supported at both ends, thereby preventing lifting.

On the tape head 23, the box frame is caught between the opposing pair of side belts 24, which are inclined downward in the forward direction of the box material, and the box frame is transported forward while the bottom of the box frame is pressed down at the tape head Therefore, the edges of the left and right outer flaps and 3*d* at the bottom opening plane of the box frame are taped by the upward facing tape head 23 while lifting of the box material is prevented.

The taping operation by the tape head occurs as the sealing rollers 115, note FIG. 8, presses and applies the adhesive side of the tape to the bottom part of the front end 2*a* of the box material 1. When the box material 1 is moved forward, the sealing roller 115 is moved correspondingly to the facing edges of the left and right outer flaps 3*c* and 3*d*, while resisting the coil spring and rotates counterclockwise. The tape 6, which is pulled out over the sealing roller 115 as the box material is moved forward, is pressed and applied to the facing edges of the left and right outer flaps 3*c* and 3*d*. A tip 122*a* of a cutter arm 122, which is equipped with the tape cutting blade 123, is pushed down by the bottom surface of the outer flaps 3*c* and 3*d*.

Another sealing roller 116, which is interlocked with the first sealing roller 115 by a connection link 117, also pushes up the tape 6, which is adhered on the facing edges of the left and right outer flaps 3*c* and 3*d* when the box material 1 is moved forward. After the first sealing roller 115 is detached from the back end of the outer flaps 3*c* and 3*d* the first sealing roller 115 maintains the lowered position while the other sealing roller 116 makes contact with the bottom surface of the outer flaps 3*c* and 3*d*.

In accordance with the foregoing, the tape 6 is pulled out and adhered on the facing edges of the left and right outer flaps 3*c* and 3*d* as the box material moves across the sealing rollers. The moment the tip 122*a* of the cutter arm 122 is detached from the back end of the outer flaps 3*c* and 3*d*, the cutter arm tip 122*a* is raised by the spring 124 and, at the same time, the tape cutting blade 123 is moved up and hits against the tape 6. The tape is stretched between the back end of the outer flaps 3*c* and 3*d* and the sealing roller 115 with tension and cuts the tape. Therefore, the length between the tip 122*a* of the cutter arms 122 and the tip of the tape cutter blade 123 is equal to the length of the cut tape end which sticks from the end of the outer flaps 3*c* and 3*d*.

Finally, when the sealing roller 116 leaves the outer flaps 3*c* and 3*d*, the head arm rotates counterclockwise from the perspective of FIG. 8, via the coil spring 118. The sealing roller 116 rolls up the bottom of the back end 2*b* of the box material note FIG. 8, as if chasing the back end 2*b* and, as shown in FIG. 3, the sealing roller presses the cut end of the tape 6 on the back end of the box material 1 to complete taping.

SUMMARY OF MAJOR ADVANTAGES OF THE INVENTION

Without attempting to detail and enumerate all of the advantages specifically and inherently disclosed in the foregoing application specification, those skilled in the art will recognize several features which provide an enhanced degree of utility of the subject invention.

The invention utilizes multiple lines of shaft-supported rollers at the left and right sides of the vertically movable body to prevent lifting of the box material. Accordingly, operators can observe processing under the rollers and prevent improper folding. Additionally, because the rollers press at multiple locations along the top edges of the left and right outer flaps of the upper portion of the box material, the bottom flaps are less likely to bend as compared with a single pressing apparatus operating at the center of the left and right flaps. Further, the rollers can adjust to changes in left and right outer flap size without the manual adjustment required in other pressing mechanisms.

The pair of side belts used to transport the box material are inclined downward in the forward direction of the box material. Accordingly, the box material can be transferred to the tape head while being pressed down, thereby preventing lifting during taping.

The lateral, flat-shaped back inner flap folding body is shaft-supported so as to rotate up and down freely at the upper part of the movable body in order to feed box material out onto the tape head. Accordingly, while the back inner flap folding body folds and holds the back inner flap of the box material in the bottom opening plane of the box material, the left and right outer flaps can be securely folded from underneath. The back inner flap folding body can then be removed effortlessly from between the flaps as the box material is pushed onto the tape head.

In describing the invention, reference has been made to preferred embodiments and illustrative advantages of the invention. Those skilled in the art, however, and familiar with the instant disclosure of the subject invention, may recognize additions, deletions, modifications, substitutions, and/or changes which fall within the purview of the subject invention and claims.

What is claimed is:

1. A box forming apparatus for closing and taping the bottom of a box comprising:

a box erecting frame;

means operably connected to said box erecting forming frame for folding bottom box flaps which fold front and back inner flaps and right and left outer flaps attached to the bottom of the box into a bottom opening plane of the box;

means operably connected to said box erecting frame for pressing an upper portion of said box located above the means for folding bottom box flaps to control lifting of the box;

means operably connected to said box erecting frame for sealing edges of the left and right outer flaps with a tape;

means operably connected to said box erecting frame for transporting the box during a sealing operation by said means for sealing;

said means for pressing includes a body movable along a vertical axis for ascending and descending movement generally above the means for folding bottom box flaps, said means for pressing further including shaft-supported rollers operably connected to said body and extending in a common plane above said means for folding bottom box flaps to prevent lifting of the box during a bottom flap folding operation; said means for sealing includes a tape head, facing upwardly at a box feed-out side of said means for folding bottom box flaps; and said means for transport includes a pair of side belts to catch and convey the box.

2. A box forming apparatus for closing and taping the bottom of a box as defined in claim 1 wherein the means for transport includes:

a pair of opposing side belts inclined downward to said tape head in the direction in which the box material advances.

3. A box forming apparatus for closing and taping the bottom of a box as defined in claim 1 wherein the means for folding the bottom flaps includes:

a support frame;

a folding body operably connected to said support frame which folds the back inner flap into the bottom opening plane of the box, said folding body being supported to enable it to rotate upward and downward.

4. A box forming apparatus for closing and taping the bottom of a box integrally formed with front and back inner flaps and right and left outer flaps, said box forming apparatus comprising:

a box erecting frame;

means operably connected to said box erecting frame for folding said front and back inner flaps and right and left outer flaps into a bottom opening plane of the box;

means operably connected to said box erecting frame for preventing upward movement-of the box during a flap folding operation of said means for folding, said means for preventing upward movement positioned generally above said means for folding and operable to ascend and descend along a vertical axis and further comprising a body portion having at least one laterally extending shaft, said at least one shaft extending in a horizontal plane such that said at least one shaft abuts a portion of said box during a flap folding operation; means for securing the left and right outer flaps in a folded and closed position; said means for securing being adjacent to said means for preventing upward movement and including a tape head for applying a strip of tape along mating edges of the right and left outer flaps of said box; and means for conveying the box during a flap securing operation including a pair of side belts to catch and convey the box frame.

5. A box forming apparatus as defined in claim 4 wherein the means for folding includes:

a support frame;

a conveyance means for moving the support frame between a first position wherein the support frame defines an outer periphery of a box flap folding zone and a second position opposed to the first position wherein the support frame is adjacent the means for securing;

a flap folding member operably connected to a distal end of said support frame and mounted on a shaft such that said folding member rotates between a first position and a second folding position wherein said back inner flap is folded into the bottom opening plane of the box frame when said folding member rotates from said removed position to said folding position.

6. A box forming apparatus as defined in claim 5 wherein the means for folding includes:

a pair of opposed folding arms journalled to rotate about an axis, each of said pair of folding arms including at least one roller whereby when said pair of opposed folding arms are caused to rotate, said rollers contact a respective left and right outer flap of said box frame and fold said flap to occupy a bottom opening plane of the box frame.

7. A box forming apparatus as defined in claim 4 wherein:

said means for securing the left and right outer flap including a tape head frame, a tape dispensing means, and a tape cutting means; and a folding body secured to a distal portion of said tape head frame journalled to rotate about an axis such that said during a rotation of said body, a front inner flap of said box frame is guided into a bottom opening plane of the box frame.

8. A box forming apparatus as defined in claim 4 wherein:

the means for preventing upward movement of the box frame during a flap folding operation by said means for folding comprises at least two shafts which extend through the body of the means for preventing upward movement and occupy a common horizontal plane and further comprising a plurality of roller elements journalled on said shafts wherein during a folding operation, upper right and left outer flaps of said box contact the roller elements which prevent movement of the box frame in an upward direction.

9. A box forming apparatus as defined in claim 4 further comprising:

a box frame loading unit operably connected to said box forming frame comprising a pair of opposed entrance guides for guiding box frames which are in a flat folded state from a loading side of said entrance guides to an exit side of said entrance guides, said exit side of said entrance guides being located adjacent a box flap folding zone, said box frame loading unit further comprising at least a pair of vacuum suction pads operable between a first position at a periphery of said box flap folding zone and a second position adjacent said exit side of said entrance guides wherein said at least pair of vacuum pads grip a folded box located at said exit side when said vacuum pads are in said second position and convey said box into the box flap folding zone as said vacuum pads travel to said first position.

* * * * *